US005729962A

United States Patent [19]

Dirx

[11] Patent Number: 5,729,962

[45] Date of Patent: Mar. 24, 1998

[54] METHOD OF LIGHTTIGHTLY PACKAGING A STACK OF LIGHT-SENSITIVE SHEETS

[75] Inventor: Lieven Dirx, Oud-Turnhout, Belgium

[73] Assignee: Agfa-Gevaert N.V., Mortsel, Belgium

[21] Appl. No.: 643,823

[22] Filed: May 7, 1996

[30] Foreign Application Priority Data

May 24, 1995 [EP] European Pat. Off. ..... 95201361

[51] Int. Cl.[6] ..... B65B 11/00

[52] U.S. Cl. ..... 53/461; 53/464; 53/465

[58] Field of Search ..... 53/461, 464, 465, 53/531, 447, 133.5, 136.3, 449, 466

[56] References Cited

U.S. PATENT DOCUMENTS

| | | | |
|---|---|---|---|
| 1,647,289 | 11/1927 | Gwinn | 53/464 |
| 3,080,691 | 3/1963 | Benner | 53/464 |
| 3,226,236 | 12/1965 | Weller | 53/449 |
| 3,479,789 | 11/1969 | Harrison | 53/464 |
| 3,645,388 | 2/1972 | Fessenden | 206/62 |
| 4,085,564 | 4/1978 | Focke | 53/461 |
| 4,563,861 | 1/1986 | Barillec et al. | 53/464 |
| 5,265,399 | 11/1993 | Miskanen et al. | 53/465 |
| 5,323,590 | 6/1994 | Garwood | 53/464 |
| 5,443,546 | 8/1995 | Bartalero | 53/464 |

FOREIGN PATENT DOCUMENTS 391494 5/1933 United Kingdom .

*Primary Examiner*—Lowell A. Larson
*Assistant Examiner*—Gene L. Kim
*Attorney, Agent, or Firm*—Baker & Botts, L.L.P.

[57] ABSTRACT

A method for lighttightly packaging a stack of light-sensitive photographic sheets in a lighttight holder comprising a rectangular tray-like base and a cover therefore, which comprises the steps of:

placing one light- and dusttight wrapping foil on said base, said wrapping foil extending beyond the periphery of said base, disposing said stack of sheets onto said wrapping foil so that the wrapping foil becomes displaced in the base and is made to conform to the inner space thereof, placing another light- and dusttight wrapping foil on said loaded stack of sheets, placing a cover on said loaded base, the two wrapping foils protruding between the base and its cover, cutting simultaneously the protruding portions of the wrapping foils, and lighttightly sealing the cover to the base.

6 Claims, 1 Drawing Sheet

METHOD OF LIGHTTIGHTLY PACKAGING A STACK OF LIGHT-SENSITIVE SHEETS

BACKGROUND OF THE INVENTION

1. Field of the Invention

The present invention relates to a method for lighttightly packaging a stack of light-sensitive photographic sheets in a lighttight holder. The invention is in particular intended for a holder for daylight-loading large-format aluminium printing plates in a so-called computer-to-plate machine.

2. Description of the Prior Art

Aluminium printing-plate packages for daylight-loading printing plates in a computer-to-plate machine are known.

One known shipping package has the form of a cassette which can be loaded by the user directly into the machine. The machine has means for opening the cassette and taking out the plates one by one for their image-wise exposure by the laser system of the machine, and next their processing.

This known package is a composite structure of corrugated cardboard for the top and the bottom of the cassette, and a wooden frame for the side walls. Since the packaged plates are highly sensitive to dust and like particles, careful treatment of the inside surfaces of the package is required in order to keep it dustfree. Suitable treatments are lacquering or taping. A package as described above has been proposed by Creo Products Inc., Burnaby, Calif.

Another plate package has been disclosed in our co-pending EP Application No. 94 203 602.1 filed Dec. 12, 1994. It comprises a stack of plates lighttightly wrapped between two lighttight wrapping foils of a size larger than that of the plates, the flaps of the wrapping extending beyond the package being backfolded on the package and peripherally closed near their edges, the size of the flaps being such as to allow lighttight clamping of the wrapping sheets onto each other along a peripheral zone located within the peripheral closure. The operator must place this package in a cassette-like frame of the apparatus, and next cut off the sealed portion of the lighttight wrapper in order to open the package. This package is thus less convenient to handle.

SUMMARY OF THE INVENTION

Object of the Invention

It is the object of the invention to provide a method for the lighttight packaging of a stack of light-sensitive photographic sheets in a lighttight holder which must not necessarily be dust-free in itself, and which allows opening of the package without extra cutting operations.

Statement of the Invention

In accordance with the present invention, a method for lighttightly packaging a stack of light-sensitive photographic sheets in a lighttight holder comprising a rectangular tray-like base and a cover therefore, comprises the steps of:

placing a lighttight and dusttight wrapping foil on said base, said wrapping foil extending beyond the periphery of said base, disposing said stack of sheets onto said wrapping foil so that the wrapping foil becomes displaced in the base and is made to conform to the inner space thereof, placing a cover on said loaded base, the cover having inner and outer peripheral areas, pressing the cover to the base while the wrapping foil is held between the base and its cover, thereby forming a lighttight and dusttight closure between the wrapping foil and the inner peripheral area of the cover, and sealing the cover to the base in a lighttight and dusttight manner along the outer peripheral area of the cover, the seal being independent of the closure between the wrapping foil and the cover along the inner peripheral area; whereby the seal may be removed while the closure between the wrapping foil and the cover remains engaged, rendering the packaging amenable to automatic loading in an imaging machine.

The advantage of the method according to the invention resides in that the wrapping foil forms an efficient barrier against possible sources of dust and the like in the tray, and this without any need for accurate positioning and/or folding of the foil in the base. The wrapping foil must have a certain oversize so that when it becomes shaped by the stack of sheets lowered in the base, it still extends beyond the periphery of the base and covers thereby any inside surface area capable of possibly causing dust.

A package made in accordance with the method of the invention can be a package intended for manual opening by the operator but, as made clear hereinbefore, it preferably is a package for daylight loading of the sheets into a lighttight cabinet arranged for opening the package to set the sheets free for further treatment. The term "cabinet" stands in the present specification for any device which gives the photographic sheets some treatment. This can be the loading of a sheet taken from the stack into an appropriate cassette, the image-wise exposure of a sheet, e.g. in an image setter, or simply the dispensing of a sheet removed from the stack to another apparatus for exposure, development, etc.

The term "light-sensitive sheets" stands for aluminium lithographic printing plates in particular, but it should be understood that any other type of photographic material on a paper, cellulose triacetate, polyester or glass base can be packaged as well according to the inventive method.

The packaged sheets or plates can be directly stacked onto each other but they can remain also separated from each other by interleaving foils.

Suitable embodiments of the method according to the invention are as follows:

a light- and dusttight wrapping foil is provided on top of the stack of sheets in the base of the holder;

this other wrapping foil likewise extends beyond the periphery of said base, and is cut simultaneously with said one wrapping foil;

this other wrapping foil is attached to said cover whereby it is removed together with the cover.

The present invention includes also a novel photographic sheet package.

In accordance with the invention, a photographic sheet package comprises a stack of light-sensitive sheets lighttightly packaged in a two-part holder, the stack of sheets being light- and dusttightly wrapped between two wrapping foils, the margins of which are lighttightly clamped onto each other between the two parts of the holder.

Suitably, one part of the holder has a tray-like shape thereby to form a base in which the stack of sheets is located, whereas the other part forms the cover for such base. The cover can have a stepped peripheral margin on the inner side so as to form a labyrinth-like closure with the base.

BRIEF DESCRIPTION OF THE DRAWINGS

The invention will be described hereinafter by way of example with reference to the accompanying drawings, wherein.

DETAILED DESCRIPTION OF THE INVENTION

Figure 1:
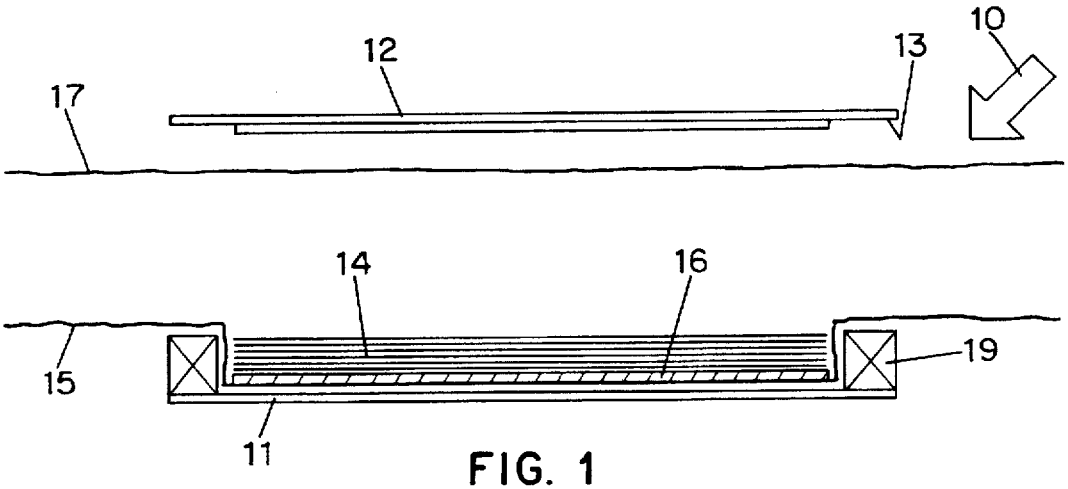
FIG. 1 shows an open holder.

The drawing of FIG. 1 diagrammatically shows one embodiment of a package made in accordance with the method according to the invention.

A holder 10 comprises a base 11 and a cover 12. The base has the form of a rectangular tray, the side walls 19 of which being made of wood, beam-like folded corrugated cardboard or the like, and the bottom being made of one or more plies of corrugated cardboard, plastic, plywood, etc. The different parts are assembled according to any known technique including glueing, stitching, taping, etc. Lid 12 can be composed of two plies of corrugated board, the inner side one being slightly smaller so as to leave a stepped peripheral margin 13 on the inner side that can form a labyrinth-like closure with the base.

A light- and dusttight wrapping foil 15 having a size notably larger than the holder is placed on the bass. One suitable material for the foil is black-pigmented low-density polyethylene. Next, a stack 14 of aluminium printing plates is disposed on the foil, whereby the foil is urged into the base and made to conform with the rectangular inside space of the base. Particularly interesting printing plates are those made in accordance with the method for making lithographic aluminium offset plates according to the diffusion transfer process, disclosed in our U.S. Pat. No. 5,273,858, and marketed under the Tradename Lithostar.

Suitably, a sheet of cardboard 16 is provided under the stack of plates of a size at least co-extensive with the plates. This sheet avoids occasional cutting of foil 15 by the sharp edges of the lowermost aluminium plate.

Figure 2:
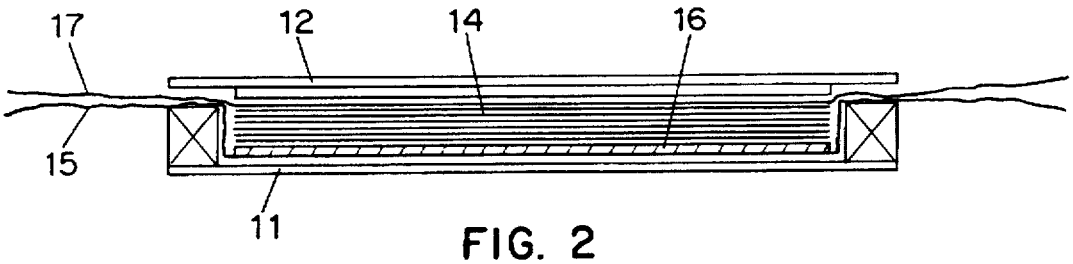
FIG. 2 shows the cover placed on the base of the holder.

A second wrapping foil 17 is disposed on the base and cover 12 is put on the base, see FIG. 2.

Figure 3:
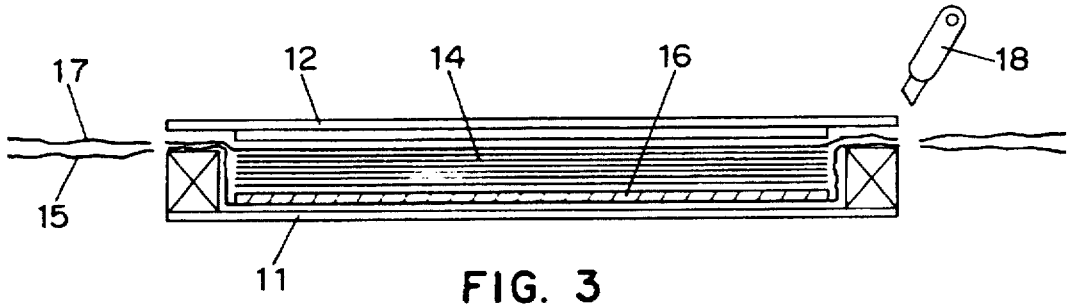
FIG. 3 shows the cutting of the wrapping foils protruding from the closed holder.

Next the portions of the two wrapping foils protruding from the holder are cut off, as illustrated by knife 18 in FIG. 3.

Figure 4:
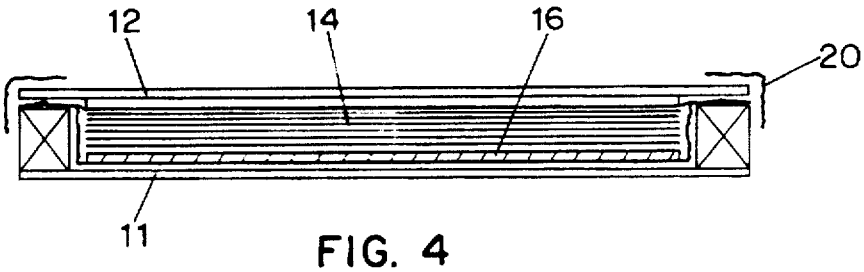
FIG. 4 shows the lighttight sealing of the package.

Finally, the holder is lighttightly closed by means of a peelable tape 20 sealing the cover to the base on all four edges, see FIG. 4.

The plate package thus made can be wrapped in a cardboard etui and next packed with a plurality of equal packages on a pallet.

The use of the described plate package can be as follows.

The operator removes the sealing tape from the holder while taking care to hold the cover on the base. Stepped margin 13 forms together with walls 19 and the two protective foils clamped therebetween a lightlock, notwithstanding removal of tape 20. Then he inserts the holder in the unloader section of e.g., a plate setter and closes the entry door thereof. Starting the apparatus causes appropriate means such as suction cups, gripper pins, clamps or the like to grip the cover and remove it from the base. The uppermost wrapping foil 17 can be taken away separately, but said foil can also have been made to adhere to the cover, e.g. by means of some dots of glue or heatsealed spots, whereby it is removed simultaneously with the cover. Means known in the art, such as suction cups, friction fingers or rollers, can then remove the plates one by one and convey them in the direction of the exposure station of the apparatus. The package can be unloaded in a horizontal position as shown, but can also be handled in a nearly vertical position.

The present invention is not limited to the embodiment described hereinbefore.

The upper wrapping foil 17 can be omitted in those circumstances in which the inner side surface of cover 12 is sufficiently dustfree, e.g. a cover made of hard plastic, or cut from board lined with a protective foil. The base of the holder can have other constructions than the described assembly of different materials. E.g. the base can be made in one piece from foamed polymer material, from moulded fiberboard pulp, etc.

I claim:

1. A method for lighttightly packaging a stack of light-sensitive photographic sheets in a lighttight holder comprising a rectangular tray-like base and a cover therefor arranged for automatic loading in an imaging machine, which comprises the steps of:

placing a lighttight and dusttight wrapping foil (15) on said base (11), said wrapping foil extending beyond the periphery of said base, disposing said stack (14) of sheets onto said wrapping foil so that the wrapping foil becomes displaced in the base and is made to conform to the inner space thereof, placing a cover (12) on said loaded base, the cover having inner and outer peripheral areas, pressing the cover to the base while the wrapping foil is held between the base and its cover, thereby forming a lighttight and dusttight closure between the wrapping foil and the inner peripheral area of the cover, and sealing the cover to the base in a lighttight and dusttight manner along the outer peripheral area of the cover, the seal being independent of the closure between the wrapping foil and the cover along the inner peripheral area; whereby the seal may be removed while the closure between the wrapping foil and the cover remains engaged, rendering the packaging amenable to automatic loading.

2. A method according to claim 1, comprising providing an other light- and dusttight wrapping foil (17) on top of said stack of sheets in said base.

3. A method according to claim 2, wherein said other wrapping foil (17) likewise extends beyond the periphery of said base (11), and is cut simultaneously with said one wrapping foil.

4. Method according to claim 2, comprising attaching said other wrapping foil to said cover whereby said foil is removed together with the cover.

5. A method according to claim 1, wherein said lighttight holder is arranged for daylight loading of the sheets in a lighttight cabinet suited for opening the package to set the sheets free for further treatment.

6. A method according to claim 1, wherein said light-sensitive sheets are aluminium printing plates.

* * * * *